US010107239B2

(12) United States Patent
Nakashima

(10) Patent No.: US 10,107,239 B2
(45) Date of Patent: Oct. 23, 2018

(54) AIR-COOLED V-TYPE ENGINE

(71) Applicant: KUBOTA Corporation, Osaka-shi, Osaka (JP)

(72) Inventor: Eishin Nakashima, Sakai (JP)

(73) Assignee: KUBOTA Corporation, Osaka-shi, Osaka (JP)

( * ) Notice: Subject to any disclaimer, the term of this patent is extended or adjusted under 35 U.S.C. 154(b) by 28 days.

(21) Appl. No.: 15/366,142

(22) Filed: Dec. 1, 2016

(65) Prior Publication Data

US 2017/0175687 A1 Jun. 22, 2017

(30) Foreign Application Priority Data

Dec. 21, 2015 (JP) ..... 2015-249003

(51) Int. Cl.

| | |
|---|---|
| ***F02M 35/10*** | (2006.01) |
| ***F01P 1/06*** | (2006.01) |
| ***F01P 5/06*** | (2006.01) |
| ***F02B 75/22*** | (2006.01) |
| ***F02F 1/24*** | (2006.01) |
| ***F02M 35/02*** | (2006.01) |
| *F02B 63/04* | (2006.01) |

(52) U.S. Cl.

CPC ..... *F02M 35/10216* (2013.01); *F01P 1/06* (2013.01); *F01P 5/06* (2013.01); *F02B 75/22* (2013.01); *F02F 1/242* (2013.01); *F02M 35/0201* (2013.01); *F02B 63/04* (2013.01)

(58) Field of Classification Search

CPC ... F02B 75/22; F02B 25/28; F01P 5/06; F01P 2001/026

See application file for complete search history.

(56) References Cited

U.S. PATENT DOCUMENTS

| | | | | |
|---|---|---|---|---|
| 2,963,009 | A * | 12/1960 | Dolza | F02B 75/221 123/184.31 |
| 6,155,895 | A * | 12/2000 | Sato | F01P 1/10 123/195 P |
| 7,040,260 | B2 * | 5/2006 | Yoshimatsu | F01P 5/06 123/41.49 |
| 2005/0081803 | A1 * | 4/2005 | Yoshimatsu | F01P 5/06 123/41.65 |
| 2005/0092284 | A1 * | 5/2005 | Nakamizo | B01D 46/0005 123/198 E |

(Continued)

FOREIGN PATENT DOCUMENTS

| | | |
|---|---|---|
| JP | 2006090255 A | 4/2006 |
| JP | 2015175349 A | 10/2015 |

*Primary Examiner* — Long T Tran

(74) *Attorney, Agent, or Firm* — Panitch Schwarze Belisario & Nadel LLP

(57) ABSTRACT

An air-cooled V-type engine includes a crankcase, a cooling fan disposed at the front end of a crankshaft, a fan casing housing the cooling fan, a pair of cylinders projecting to form a V shape from the crankcase as seen in a direction along an axial center of the crankshaft, and cylinder heads. A distributor for distributing supply fuel from a fuel supply apparatus to intake air passages of respective cylinders is disposed to straddle a contained angle place being a place between the cylinders forming the V shape. Ignition coils respectively corresponding to the cylinders are mounted on the distributor. The distributor is mounted on an air cleaner supporting plate disposed at the contained angle place.

12 Claims, 12 Drawing Sheets

(56) References Cited

U.S. PATENT DOCUMENTS

| | | | | |
|---|---|---|---|---|
| 2009/0194351 | A1* | 8/2009 | Murasawa | B62K 11/04<br>180/219 |
| 2009/0293821 | A1* | 12/2009 | Nakamizo | F01P 5/06<br>123/41.65 |
| 2009/0293835 | A1* | 12/2009 | Nakamizo | F01P 11/12<br>123/198 E |

* cited by examiner

AIR-COOLED V-TYPE ENGINE

BACKGROUND OF THE INVENTION (1) Field of the Invention

The present invention relates to an air-cooled V-type engine for general purpose use, such as for use in a power generator.

(2) Description of Related Art

An exemplary known air-cooled V-type engine has the following structure. That is, an air-cooled V-type engine includes a crankcase, a crankshaft, a fan casing, and an engine cooling fan. The fan casing is disposed in front of the crankcase, and the engine cooling fan is housed in the fan casing. This engine can be easily cooled with cooling air sent from the engine cooling fan.

In general, as compared to a vertical type engine, a V-type engine is advantageous in its lowered center of gravity attributed to its reduced height, and in reduced torsional vibrations attributed to its shortened crankshaft. Such an air-cooled V-type engine employs a carburetor as a fuel supply apparatus, so that it can be manufactured at low costs with a simple structure while possessing the above-described advantages, as an inexpensive model or as a specification for developing countries.

Further, a V-type engine which is clean, fuel-efficient, and drives under various control modes has also been developed as a sophisticated model equipped with a fuel injection system (fuel injector) as the feel supply apparatus. In this case, the structure for supplying fuel injected from the fuel injection apparatus such as a fuel injector to each cylinder head is one of the key stones of engine design.

A document disclosing the V-type engine including a fuel injection system briefly states: "a pair of fuel injectors are disposed in front of intake manifolds, and the fuel injectors are housed in an upper casing". If is considered that there is plenty of scope for improvement in strategically structuring an air-cooled V-type engine including a fuel injection apparatus.

SUMMARY OF THE INVENTION

An object of the present invention is to provide a strategically structured air-cooled V-type engine including a fuel injection apparatus, focusing mainly on the structure of supplying fuel.

The present invention provides an air-cooled V-type engine including: a crankcase; a crankshaft; an engine cooling fan mounted on one end of the crankshaft; a fan casing housing the engine cooling fan; a plurality of cylinders projecting to form a V shape from the crankcase as seen in a direction along an axial center of the crankshaft; and a cylinder head mounted on a tip side of each of the cylinders. The air-cooled V-type engine further includes a distributor for distributing supply fuel from a fuel supply apparatus to an intake air passage of each of the cylinders; and an ignition coil provided for each of the cylinders. The distributor is disposed to straddle a contained angle place being a place between the cylinders forming the V shape. The ignition coils are mounted on the distributor.

The present invention employs the structure in which a distributor for supplying supply fuel from a fuel supply apparatus to the cylinders is disposed to straddle a contained angle place which is a place between the cylinders forming a V shape, and an ignition coil required for each of the cylinders is mounted on the distributor.

That is, the distributor and the plurality of ignition coils are three-dimensionally disposed using the contained angle place which is intrinsically resulted from the structure of a V-type engine. Engine accessories (the distributor, the ignition coils and the like) which occupy a wide space because of the provision of the fuel injection apparatus are centrally disposed at the contained angle place which tends to have an irregular shape. Thus, the contained angle place is effectively used.

As a result fee present invention provides a strategically structured air-cooled V-type engine including a fuel injection apparatus, effectively using a contained angle place which is intrinsically difficult to be used, by focusing mainly on the structure of supplying fuel.

DETAILED DESCRIPTION OF PREFERRED EMBODIMENTS

Figure 1:
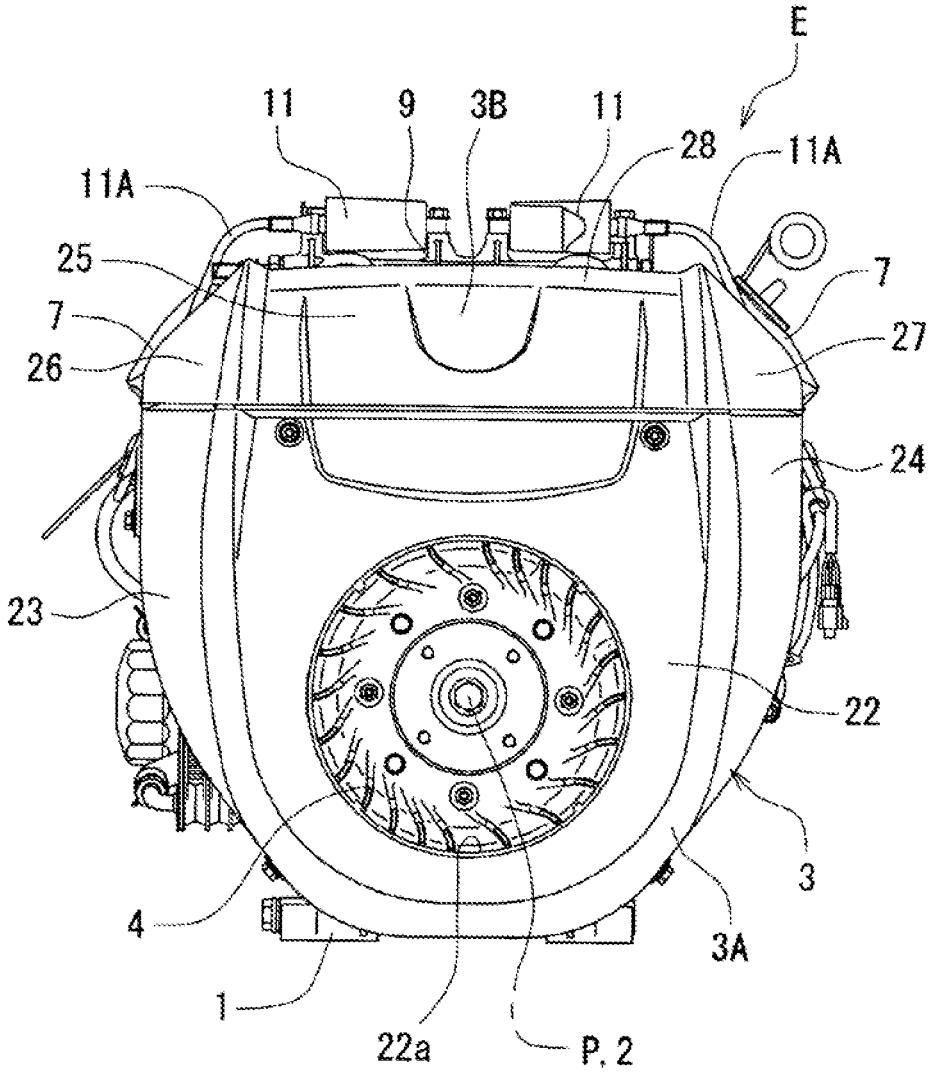
FIG. 1 is a front view of an air-cooled V-type engine of the present invention.

In the following, with reference to the drawings, a description will be given of an embodiment of an air-cooled V-type engine of the present invention as a forced air-cooled two-cylinder engine.

As shown in FIGS. 1 to 8, an air-cooled V-type engine E of the present invention includes a crankcase 1, a crankshaft 2, a fan casing 3, and an engine cooling fan 4. Defining that the direction in which the crankshaft 2 is suspended is the front-rear direction and one end in the front-rear direction is the front and other end is the rear, the fan casing 3 is provided in front of the crankcase 1, and the engine cooling fan 4 mounted on the front end (an example of one end) of the crankshaft 2 is housed in the fan casing 3.

As seen in the axial center P direction of the crankshaft 2, the air-cooled V-type engine E further includes a pair of (an example of a plurality of) cylinders 5, 5 projecting upper rightward and leftward from the crankcase 1 to form a V shape, cylinder heads 6, 6 respectively mounted on the upper end side (tip side) of the cylinders 5, 5, and cylinder head covers 7, 7 respectively mounted cm the tip side of the cylinder heads 6, 6. As shown in FIGS. 1 to 4, the fan casing 3 is structured to have the size and shape enable of covering the cylinders 5, 5 and the cylinder heads 6, 6, so that the engine cooling fan 4 can easily forcibly cool the engine.

Figure 5:
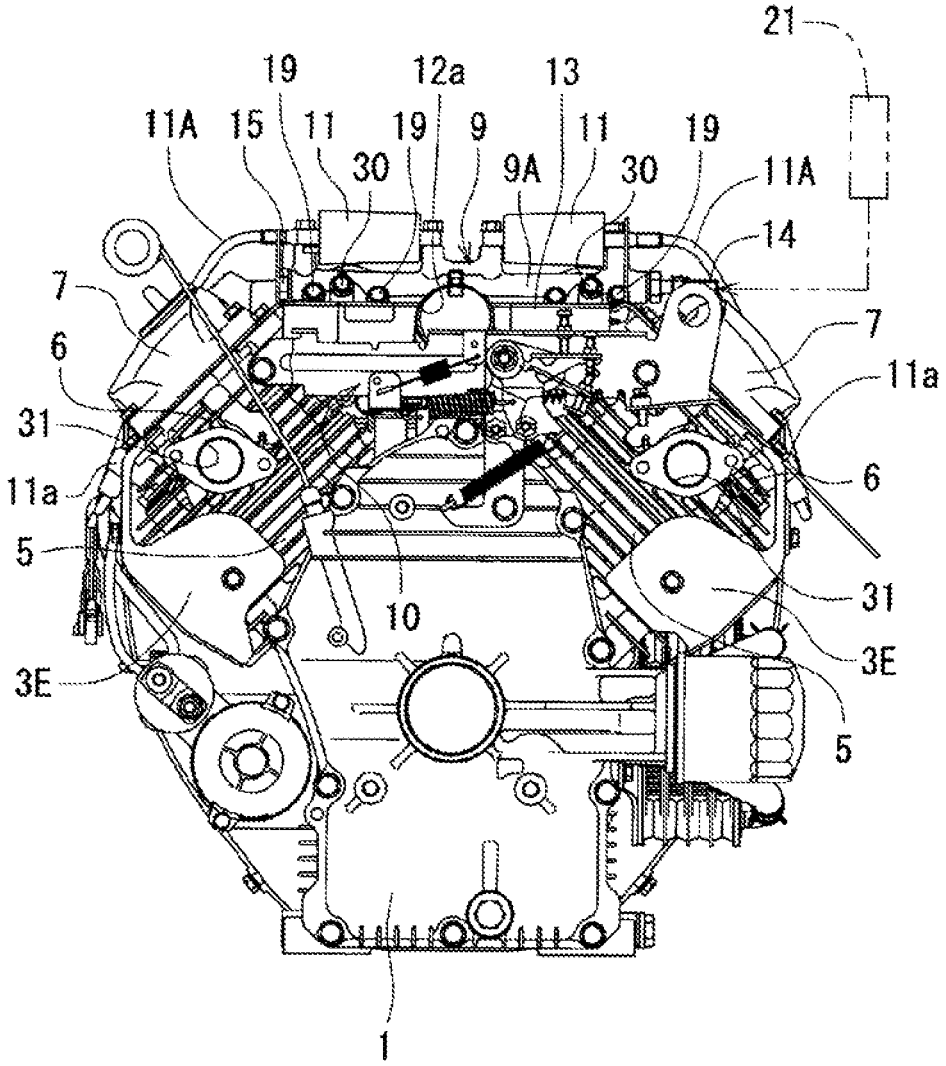
FIG. 5 is a rear view of the engine shown in FIG. 1.
Figure 6:
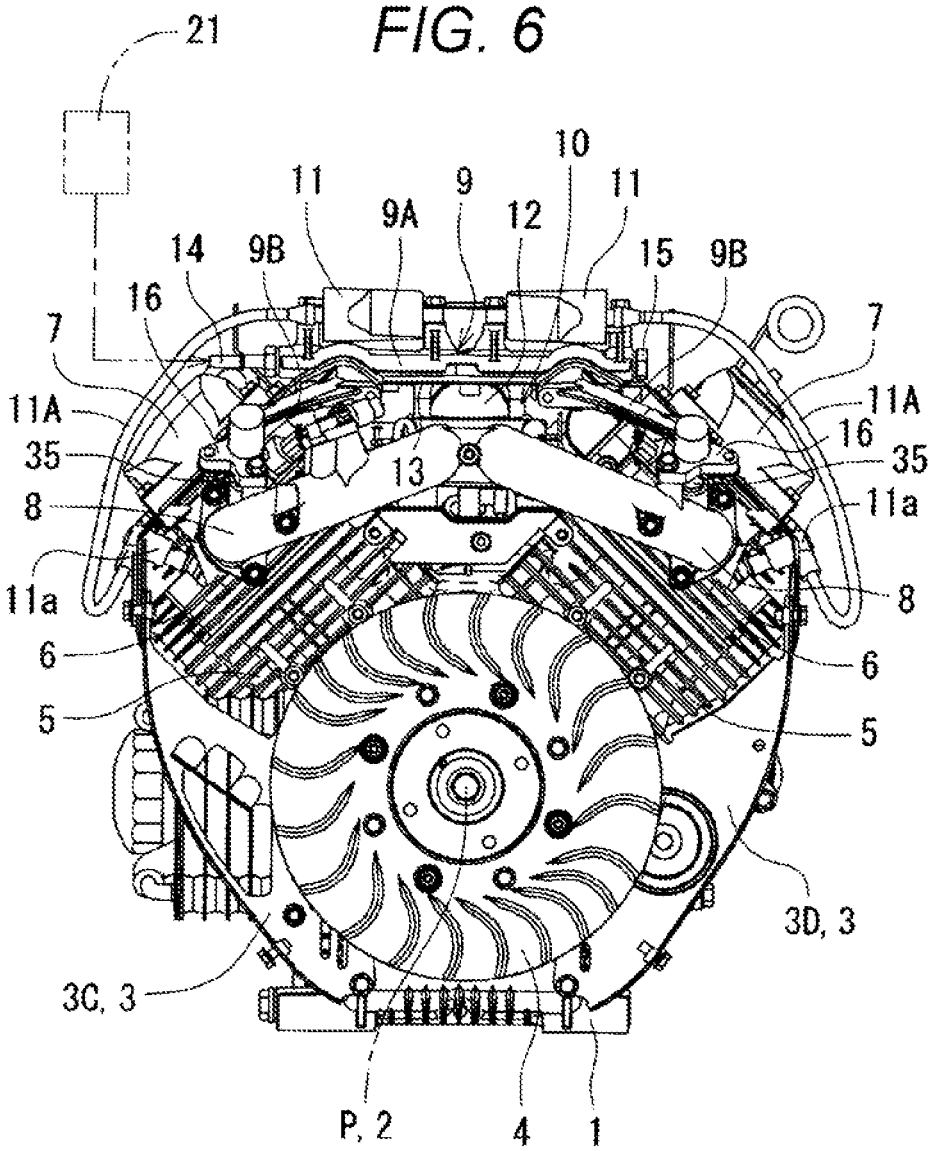
FIG. 6 is a front view of the engine shown in FIG. 1 in which a fan casing is not shown.

That is, the air-cooled V-type engine E includes the crankcase 1, the engine cooling fan 4 mounted on one end of the crankshaft 2, the fan casing 3 housing the engine cooling fan 4, a plurality of cylinders 5, 5 projecting to form a V shape from the crankcase 1 as seen in the axial center P direction of the crankshaft 2, and the cylinder heads 6, 6 respectively mounted on the tip side of the cylinders 5, 5. Note that, FIG. 5 shows exhaust outlets 31, 31 of the cylinder head 6.

As shown in FIGS. 5 to 8, a throttle body 12 is disposed at a contained angle place 10 which is a place (space) between the right and left cylinders 5, 5 and the cylinder heads 6, 6. Right and left intake manifolds 8, 8 are downwardly tilted to extend from the throttle body 12 to air inlets 6*a*, 6*a* of cylinder heads 6, 6. The intake manifolds 8, 8 are provided on the front side which is the side where the engine cooling fan 4 is disposed. The exhaust outlets 31, 31 of the cylinder heads 6, 6 are provided on the rear side.

A distributor 9 for distributing supply fuel from a fuel supply apparatus 21 to the intake manifolds (an example of intake air passages) 8, 8 of the cylinders 5, 5 (the cylinder heads 6, 6) is disposed to straddle the contained angle place 10, which is a place between the cylinders forming a V shape. A pair of right and left legs 9B, 9B in the distributor 9 are coupled near the cylinder heads of the intake manifolds 8, 8 so as to establish communication via fuel injection apparatuses 35 such as injectors. Accordingly, the supply fuel from the fuel supply apparatus 21 is injected from the fuel injection apparatuses 35, 35 via the distributor 9, and the injected fuel is supplied to the cylinder heads 6, 6 through the intake manifolds 8, 8.

Immediately above the throttle body 12, an air cleaner mounting plate (an example of an air cleaner supporting structure) 13 of the both end supported structure is provided. That is, the air cleaner mounting plate 13 straddles the contained angle place 10 and is fixed to the right and left cylinder heads 6, 6 with bolts. The center of the air cleaner mounting plate 13 is largely cut out from the rear toward the front. In this cutout part 13*a*, an intake portion 12*a* of the throttle body 12 is disposed as being tilted to rise rearward. The air cleaner mounting plate 13 is a plate for fixedly supporting a not-shown air cleaner.

On the upper side of the air cleaner mounting plate 13, the distributor 9 in a horizontal posture is disposed as being supported by the air cleaner mounting plate 13. On the distributor 9, ignition coils 11, 11 respectively provided for the pair of cylinders 5, 5 are aligned and supported on the right and left sides (in the direction perpendicular to the axial center P) as being oriented in mutually laterally opposite directions. Note that, in FIG. 8, on the distributor 9, a mounting plate 32, which is substantially T-shaped in a plan view, is mounted so as not to interfere with the ignition coils 11, 11.

That is, the distributor 9 for distributing the received fuel to the intake air passages 8, 8, of the cylinders 5, 5, or more specifically, to the fuel injection apparatuses 35, 35 mounted on the intake manifolds 8, 8, is disposed to straddle the contained angle place 10 being the place between the cylinders 5, 5 forming a V-shape. The ignition coils 11, 11 respectively provided for the plurality of cylinders 5, 5 are attached to the distributor 9. The distributor 9 is a functional component that distributes, to the fuel injection apparatuses 35, 35, supply fuel (such as pressurized fuel) from the fuel supply apparatus 21 formed by, for example, a fuel pump that pressurizes and discharges fuel.

In this structure, from the bottom to the top, the throttle body 12, the air cleaner mounting plate 13, the distributor 9, and the ignition coils 11 are three-dimensionally disposed in this order at the contained angle place 10.

High tension cords (output lines) 11A, 11A of the ignition coils 11, 11 extend to detour the front side of the cylinder head covers 7, 7. Plug caps 11*a*, 11*a* mounted on the end of the cords are fitted to spark plugs 29, 29 disposed respectively on the right and left outer sides of the right and left cylinder heads 6, 6.

As shown in FIGS. 9, 10A, 10B, 12B and others, the distributor 9 includes a distributor body 9A which is a molded article such as an aluminum die casting, and the legs 9B, 9B fixed with bolts or the like respectively to the right and left ends of the distributor body 9A. In the distributor body 9A, a supply passage 9*a* extending laterally is formed. A receiving pipe 14 is screwed on the left ends of the distributor body 9A, and a scaling plug 15 which is a bolt or the like is mounted on the right end.

To the legs 9B, 9B each being a molded article such as an aluminum die casting, flanges 16, 16 where internal passages 9*b*, 9*b* open are formed. In the state where the legs 9B, 9B are mounted on the distributor body 9A, communication passages 17, 17 communicating with the supply passage 9*a* respectively communicate with the basal end of the manual passages 9*b*, 9*b*. The flange 16 of each leg 9B coupled with bolts to corresponding intake manifold 8 via the feel injection apparatus 35 such as an injector disposed between the flange 16 and the intake manifold. The intake passage (not shown) inside the intake manifold 8 and the internal passage 9*b* are communicatively connected via the fuel injection apparatus 35.

Accordingly, the assembly in which the legs 9B, 9B are mounted on the distributor body 9A, that is, the distributor 9, is structured to distribute supply fuel, such as pressurized fuel coming in from the receiving pipe 14, from the supply passage 9*a* to the internal passages 9*b*, 9*b* through the communication passages 17, 17.

The supply fuel from the internal passages 9*b*, 9*b* are injected into the intake manifolds 8, 8 by the fuel injection apparatuses 35, 35, and sent to the cylinder heads 6, 6 while forming air-fuel mixture with the air flowing inside the intake manifolds 8, 8.

Figure 2:
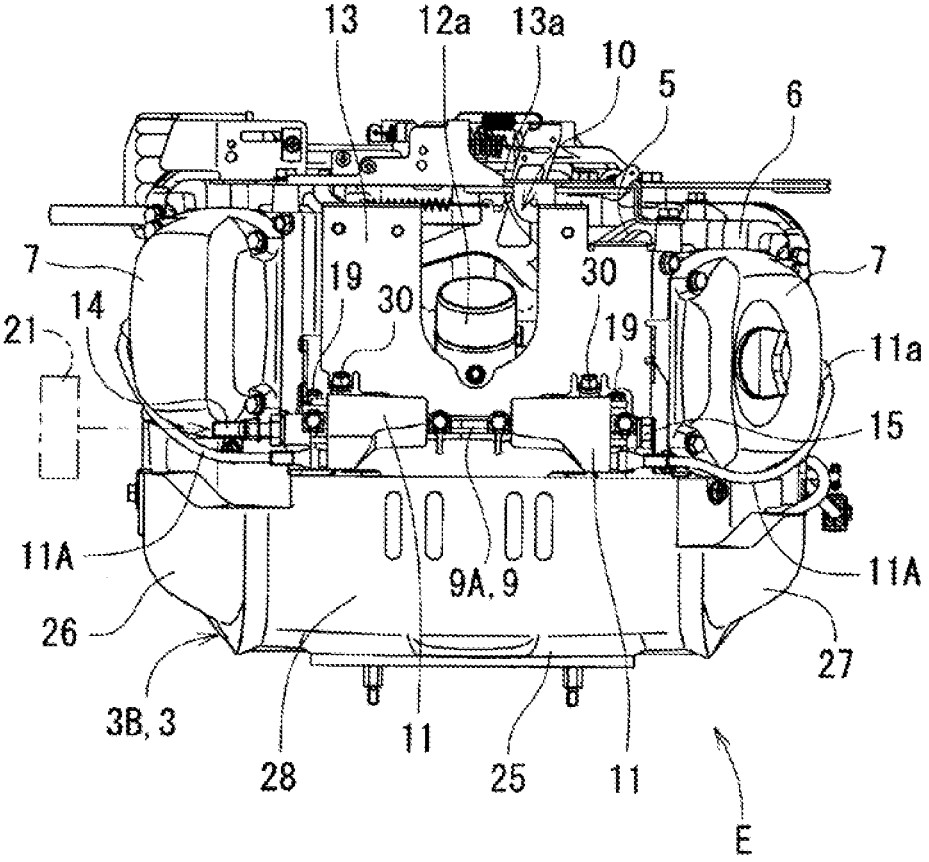
FIG. 2 is a plan view of the engine shown in FIG. 1.
Figure 3:
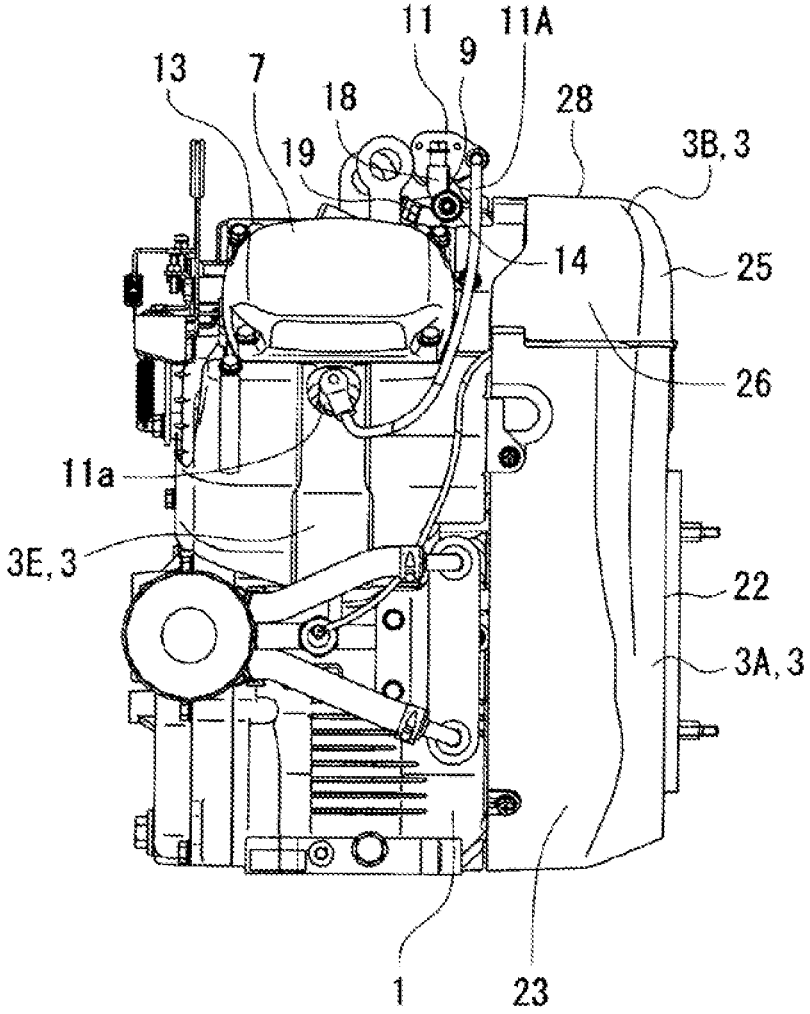
FIG. 3 is a left side view of the engine shown in FIG. 1.
Figure 4:
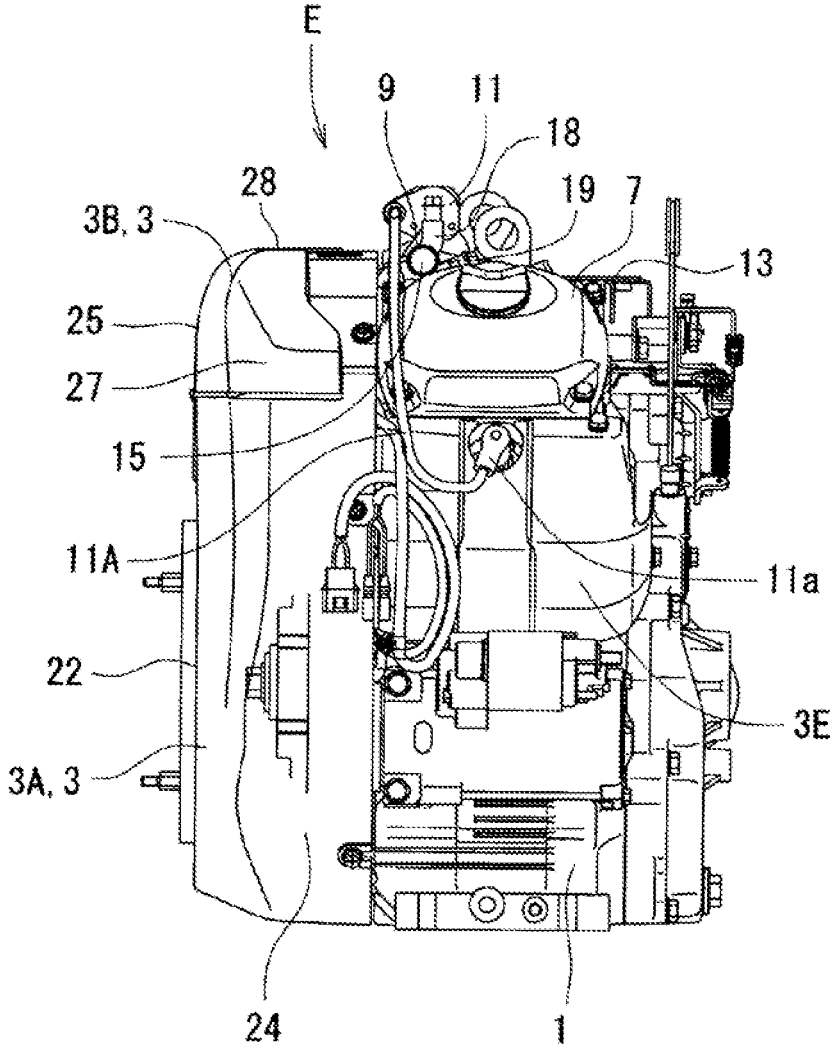
FIG. 4 is a right side view of the engine shown in FIG. 1.
Figure 7:
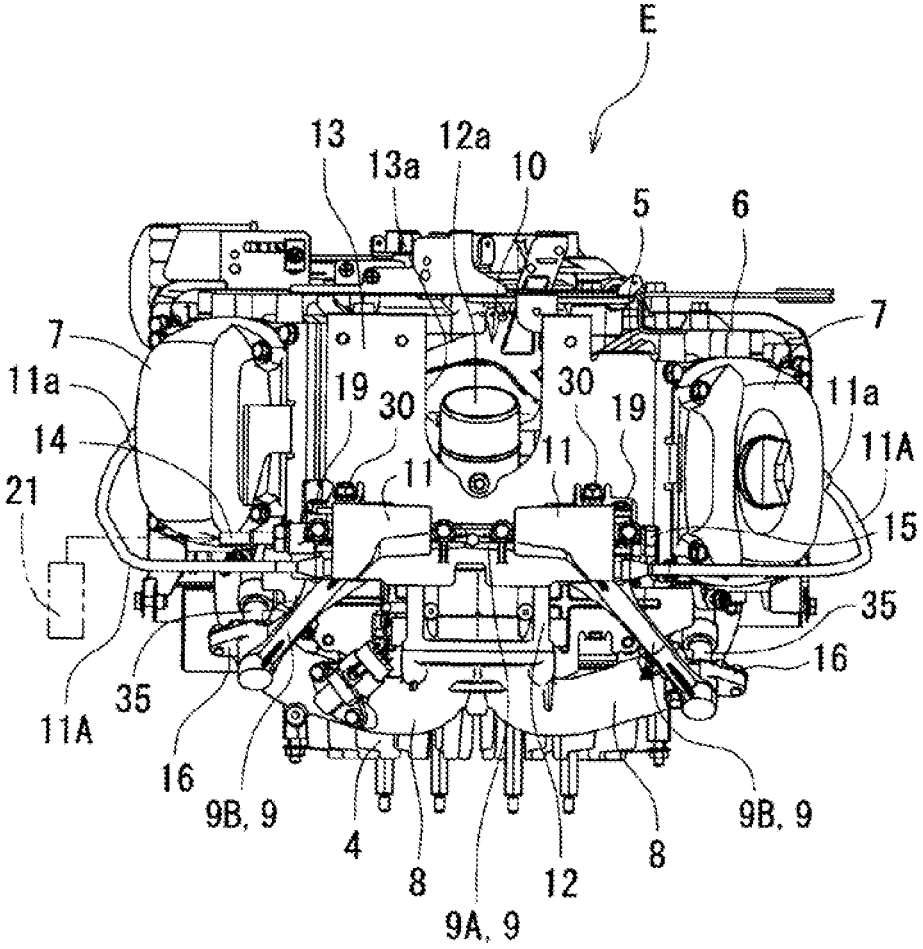
FIG. 7 is a plan view of the engine shown in FIG. 1 in which the fan casing is not shown.
Figure 8:
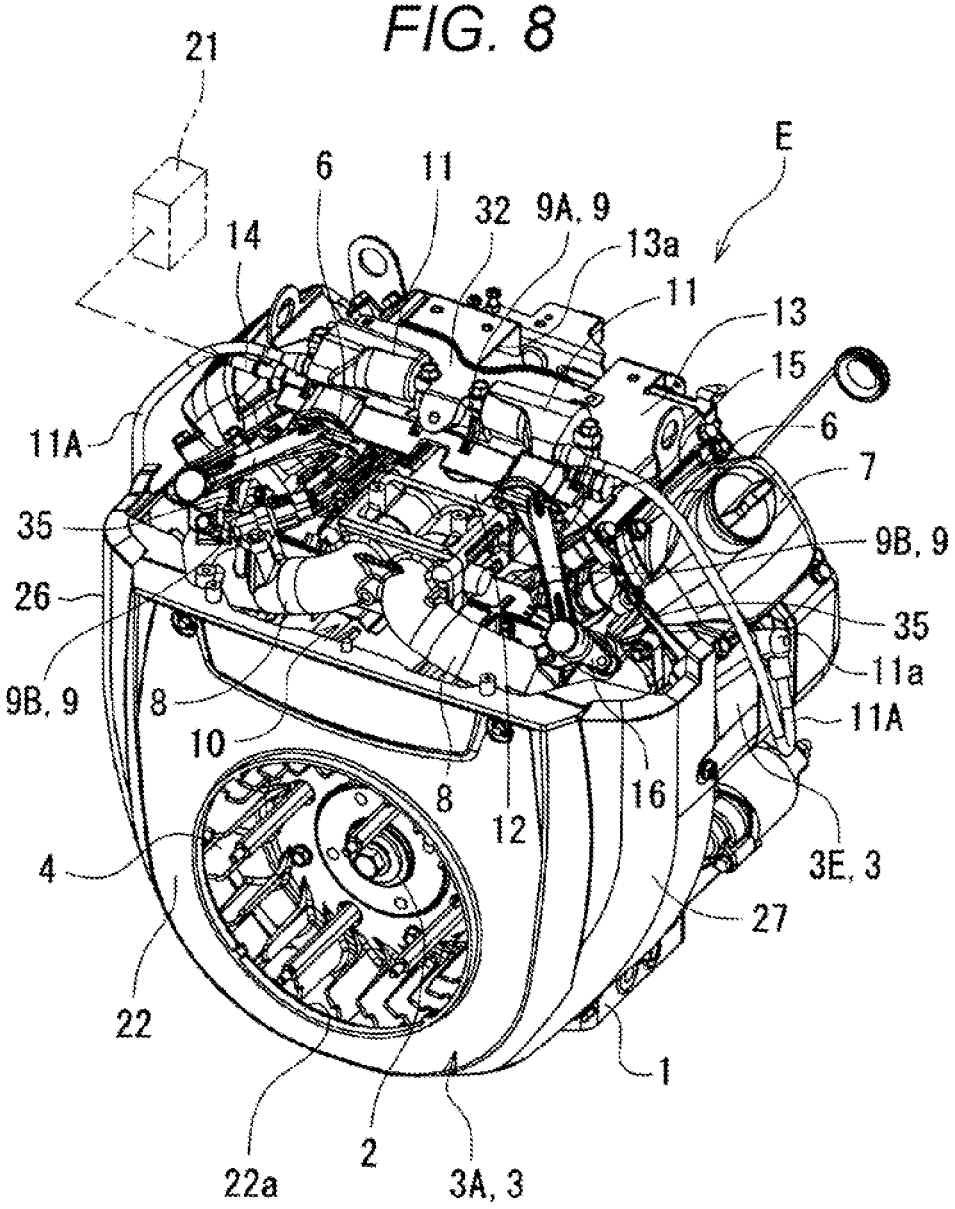
FIG. 8 is a perspective view of the engine shown in FIG. 1 as diagonally seen from an upper right-hand point.
Figure 9:
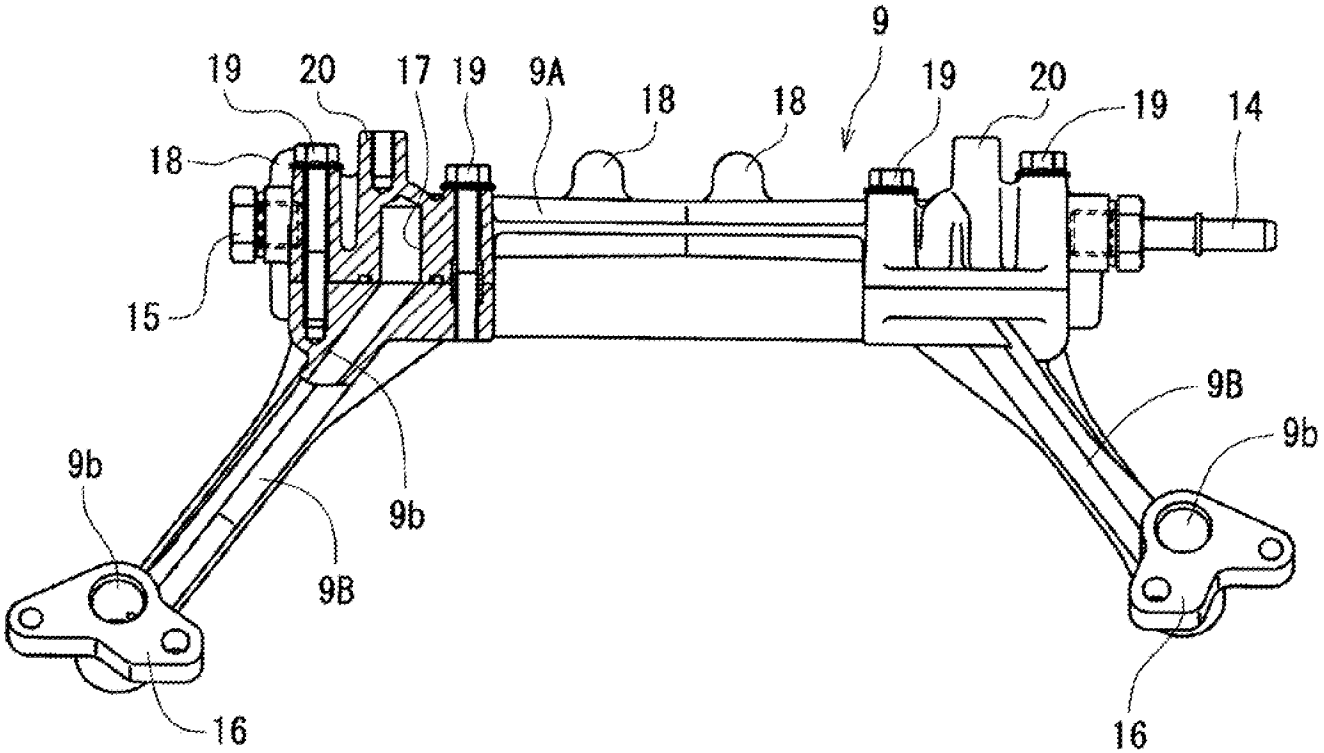
FIG. 9 is a partially cutaway bottom view of a distributor.
Figure 10A:
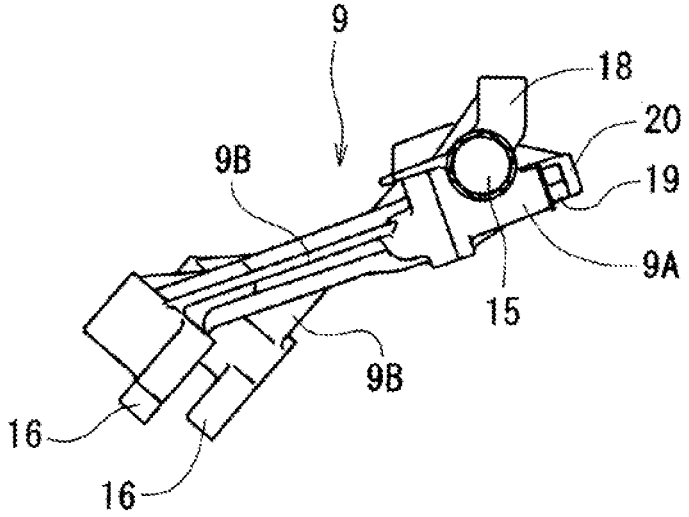
FIG. 10A is a right side view of the distributor shown in FIG. 9.
Figure 10B:
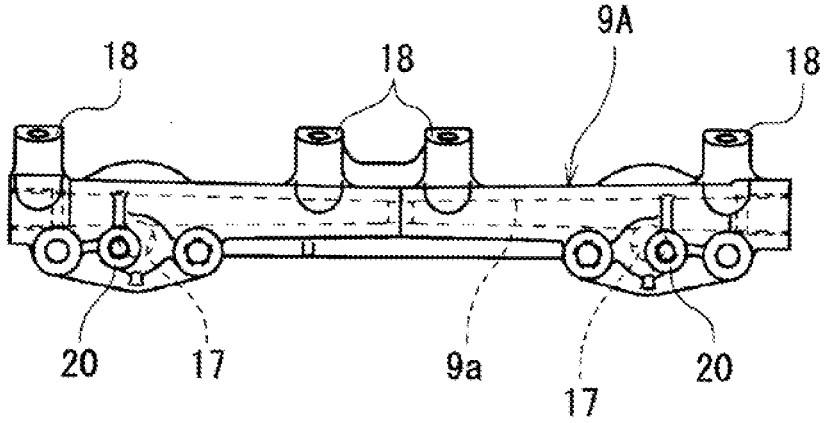
FIG. 10B is a schematic rear view of a distributor body.

At the distributor body 9A, four nut parts 18, 18, 18, 18 for fixing the ignition coils 11, 11 each at two positions are projected upward while being aligned laterally. Between a pair of assembling bolts 19, 19 for fixing one leg 9B, a mounting nut part 20 is provided to project rearward. That is, the mounting nut parts 20 are provided two in number in total, on the right and left sides. For example, as shown in FIGS. 2 and 7, the distributor 9 can be mounted on the air cleaner mounting plate 13, by being fixed to a plate-like bracket (not shown) provided so as to project at the air cleaner mounting plate 13, using two mounting nut parts 20, 20 and two bolts 30, 30. Any other mounting scheme may be employed.

As shown in FIGS. 1 to 4 and 8, the fan casing 3 includes a casing body 3A that covers the engine cooling fun 4 and most part of the right and left cylinders 5, 5 in the axial center P direction, an upper casing 3B that covers the right and left cylinder heads 6, 6 and the cylinder head covers 7, 7 in the axial center P direction, a left back wall 3C, a right back wall 3D, and guide walls 3E, 3E respectively disposed at the side surface of the cylinder heads 6, 6.

The casing body 3A includes a front wall 22, and a left sidewall 23 and a right sidewall 24 being continuous to the front wall 22. A large intake port 22*a* is formed at the front wall 22. The upper casing 3B includes a front wall 25, a left wall 26, a right wall 27, and an upper wall 28.

Rotation of the centrifugal engine cooling fan 4 powerfully blows air suctioned from the intake port 22*a* of the casing body 3A, in the centrifugal direction relative to the axial center P as cooling air from the engine cooling fan 4. The blowing cooling air is guided by the fan casing 3 made up of the casing body 3A and the upper casing 3B to the right and left cylinders 5, 5 and the cylinder heads 6, 6 and cools them. The cooling air is also guided to the contained angle place 10 between the right and left cylinders 5, 5, and thereby capable of also cooling the throttle body 12, the distributor 9, the ignition coils 11, 11 and the like.

In the V-type engine in which the cylinders 5, 5 tilt respectively rightward and leftward relative to the axial center P of the crankshaft 2, what is formed is the contained angle place 10, which is a space formed between the right and left cylinders 5, 5 in a shape of a triangle pointing downward as seen in the axial center P direction. Accordingly, using the air cleaner mounting plate 13 suspended across the right and left cylinder heads 6, 6, the throttle body 12 is disposed beneath the air cleaner mounting plate 13, and the distributor 9 on which two ignition coils 11, 11 are fixedly placed is disposed on the air cleaner mounting plate 13. This achieves the strategic layout capable of effectively using the contained angle place 10 and also cooling the components 12, 9, 11.

The air-cooled V-type engine E of the present invention is characterized in the following.

The ignition coils 11, 11 are supported by the distributor 9 as being aligned in the direction perpendicular to the axial center P.

Accordingly, since a plurality of ignition coils supported by the distributor are aligned in the direction perpendicular to the axial center P, that is, in the aligning direction of the cylinders forming a V shape, the ignition coils and their high tension cords, the cylinders and the cylinder heads can be disposed as being aligned in the identical direction.

As a result, effective use of the space formed in the aligning direction of the cylinders is promoted, and the operation and effect brought about by the aspect of the invention according to claim 1 is advantageously reinforced.

The cylinders 5, 5 forming a V shape are allocated respectively on the right side and the left side relative to the axial center P. The ignition coils 11, 11 are disposed to be oriented in mutually laterally opposite directions on the distributor 9 in a horizontal posture.

Accordingly, the structure in which the ignition coils are oriented in mutually laterally opposite directions shortens the length of the high tension cords of the ignition cods disposed at the contained angle place, that is, allows the high tension cords to directly extend to the corresponding cylinders. This provides the further strategically structured air-cooled V-type engine.

The distributor 9 is mounted on the air cleaner supporting plate 13 disposed at the contained angle place 10.

Thus, the distributor is mounted on the air cleaner supporting plate disposed at the contained angle place, that is, one supporting structure is used in a shared manner. This provides the even further strategically structured air-cooled V-type engine.

The fan casing 3 is shaped to guide cooling air from the engine cooling fan 4 to the contained angle place 10.

The shaping of the fan casing causes the engine cooling air to be guided to the contained angle place. Thus, the cooling air cools not only the cylinders and the cylinder heads, but also the engine accessories such as the distributor which are susceptible to the radiant heat because of their placement between the cylinders. Thus, additionally advantageously, the engine drives further stably.

Other Embodiment

Figure 11:
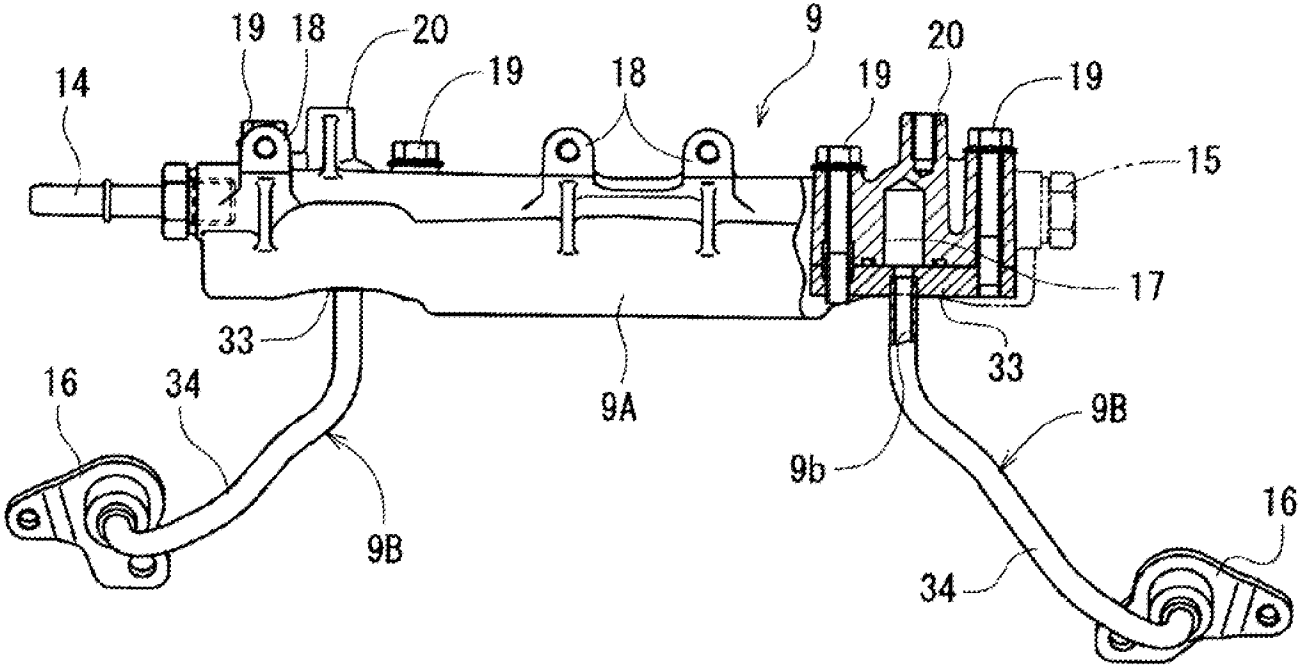
FIG. 11 is a partially cutaway schematic plan view of the distributor in other structure.
Figure 12A:
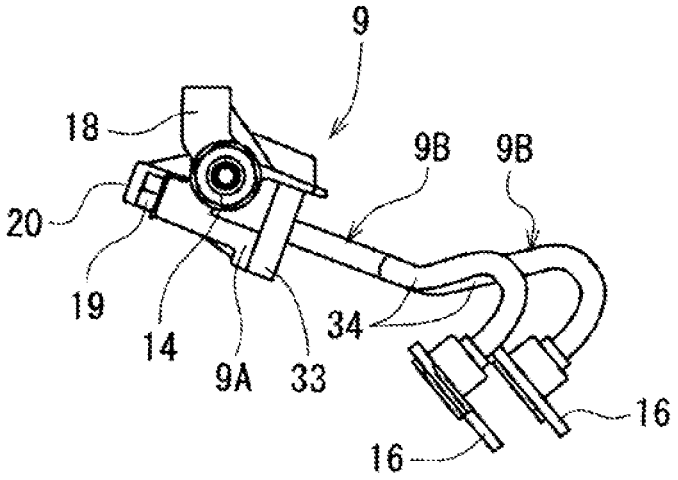
FIG. 12A is a left side view of the distributor shown in FIG. 11.
Figure 12B:
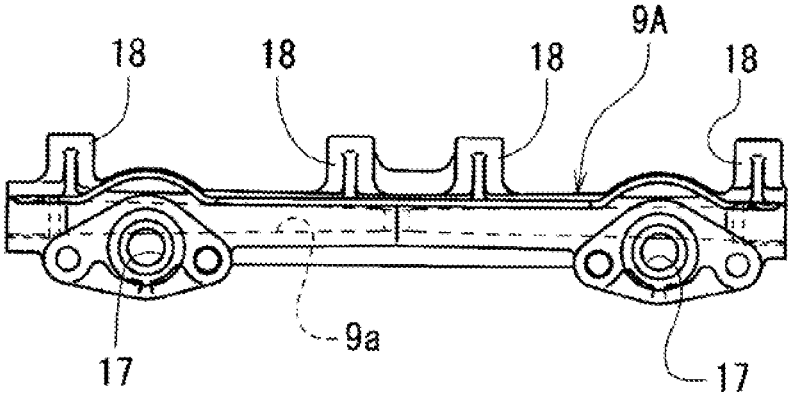
FIG. 12B is a schematic front view of the distributor body.

The distributor 9 may have the structure shown in FIGS. 11 and 12A. That is, the distributor 9 of other structure is different from the distributor 9 shown in FIG. 9 in that the legs 9B, 9B are formed by metal pipes instead of die castings. The distributor body 9A is identical in both the structures.

Each leg 9B is structured by integrating a basal end flange 33 fixed to the distributor body with two assembling bolts 19, 19, a metal pipe part 34 having an internal passage 9*b* (not shown) and made of copper, brass or the like, and the flange 16. The leg 9B formed by a pipe can be highly possibly manufactured at low costs as compared to the leg 9B being a die casting.

Other Application

The present invention is also applicable to a vertical type four-cylinder air-cooled V-type engine in which two front and rear cylinders are aligned on each of the right and left sides of the crankshaft 2, or to a lateral air-cooled V-type engine in which cylinders project laterally diagonally upward and downward from the crankshaft 2.

What is claimed is:

1. An air-cooled V-type engine comprising:

a crankcase;

a crankshaft;

an engine cooling fan mounted on one end of the crankshaft;

a fan casing housing the engine cooling fan;

a plurality of cylinders projecting to form a V shape from the crankcase as seen in a direction along an axial center of the crankshaft; and a cylinder head mounted on a tip side of each of the cylinders, wherein the engine further comprises a distributor configured to distribute supply fuel from a fuel supply apparatus to an intake air passage of each of the cylinders and an ignition coil provided for each of the cylinders, and wherein the distributor is disposed to straddle a contained angle place being a place between the cylinders forming the V shape, and the ignition coils are mounted on the distributor.

2. The air-cooled V-type engine according to claim 1, wherein the ignition coils are supported by the distributor as being aligned in a direction perpendicular to the axial center.

3. The air-cooled V-type engine according to claim 2, wherein the cylinders forming a V shape are allocated respectively on a right side and a left side relative to the axial center, and the ignition coils are disposed to be oriented in mutually laterally opposite directions on the distributor in a horizontal posture.

4. The air-cooled V-type engine according to claim 3, wherein the distributor is mounted on an air cleaner supporting structure disposed at the contained angle place.

5. The air-cooled V-type engine according to claim 4, wherein the fan casing is shaped to guide cooling air from the engine cooling fan to the contained angle place.

6. The air-cooled V-type engine according to claim 3, wherein the fan casing is shaped to guide cooling air from the engine cooling fan to the contained angle place.

7. The air-cooled V-type engine according to claim 2, wherein the distributor is mounted on an air cleaner supporting structure disposed at the contained angle place.

8. The air-cooled V-type engine according to claim 7, wherein the fan casing is shaped to guide cooling air from the engine cooling fan to the contained angle place.

9. The air-cooled V-type engine according to claim 2, wherein the fan casing is shaped to guide cooling air from the engine cooling fan to the contained angle place.

10. The air-cooled V-type engine according to claim 1, wherein the distributor is mounted on an air cleaner supporting structure disposed at the contained angle place.

11. The air-cooled V-type engine according to claim 10, wherein the fan casing is shaped to guide cooling air from the engine cooling fan to the contained angle place.

12. The air-cooled V-type engine according to claim 1, wherein the fan casing is shaped to guide cooling air from the engine cooling fan to the contained angle place.

* * * * *